United States Patent [19]

Kouris

[11] 4,254,645

[45] Mar. 10, 1981

[54] THREAD DYEING KIT

[76] Inventor: Spiro Kouris, 1167 Pierre St., Windsor, Ontario, Canada, N9A 2L3

[21] Appl. No.: 90,913

[22] Filed: Nov. 5, 1979

[30] Foreign Application Priority Data

Feb. 27, 1979 [CA] Canada ..... 322394

[51] Int. Cl.[3] ..... D06B 1/10

[52] U.S. Cl. ..... 68/213; 68/27; 68/200; 112/270; 118/234; 118/264; 206/207; 206/227

[58] Field of Search ..... 68/213, 27, 200; 118/234, 264, 266, 267, 268, DIG. 18; 112/270, 280; 206/205, 207, 227, 574; 401/9, 10; 128/335.5; 223/109 R

[56] References Cited

U.S. PATENT DOCUMENTS

| | | | |
|---|---|---|---|
| 40,484 | 11/1863 | Hyde | 118/264 |
| 1,576,013 | 3/1926 | Thomayer | 68/200 |
| 1,800,253 | 4/1931 | Heilweil | 118/234 |
| 2,120,110 | 6/1938 | Morrell | 118/234 X |
| 2,434,861 | 1/1948 | Pachner | 401/88 |
| 2,743,470 | 5/1956 | Horowitz | 401/10 |
| 2,846,705 | 8/1958 | Marz | 118/234 X |
| 2,910,026 | 10/1959 | Ajouelo | 118/264 X |
| 3,023,599 | 3/1962 | Pellegrini | 68/213 |

FOREIGN PATENT DOCUMENTS

| | | | |
|---|---|---|---|
| 334781 | 8/1933 | Canada . | |
| 350056 | 6/1931 | United Kingdom | 68/200 |

*Primary Examiner*—Philip R. Coe

*Attorney, Agent, or Firm*—Stevens, Davis, Miller & Mosher

[57] ABSTRACT

A portable thread dyeing kit comprises, preferably, a plurality of separate compartments each containing a liquid dye with an integral felt piece inside the compartment, the felt piece reaching into the dye and being soaked with same. Near the top of each compartment is a pair of orifices in opposite side walls of the compartment for transversely passing a needle through the container and through the respective felt piece. Accordingly, as a white thread is passed through the appropriate felt piece, the thread is dyed to the respective color. The device is extremely simple and thus inexpensive to produce as it avoids split arrangement of absorbent pads used for the same purpose in prior art.

5 Claims, 3 Drawing Figures

THREAD DYEING KIT

The present invention relates to a portable thread dyeing kit particularly for emergency use on travel or the like, of the type wherein a normally white thread is passed over a dye soaked absorbent material such as felt or the like, to provide the thread with the desired color.

The principle of dyeing or oiling a thread by passing same over an absorbent material soaked with a desired dye has long been known in the art.

Reference may be had, for instance, to U.S. Pat. No. 40,484, issued to O. R. Hyde, on Nov. 3, 1863. The device according to this reference is proposed for oiling thread in sewing machines and generally comprises a box housing a sponge. In the top of the box is provided a slot for passage of the thread over the top of the sponge. Furthermore, the top of the box comprises an orifice for filling oil into the box and thus into the sponge material. In use, the thread passes in the slot and over the exposed top of the sponge housed in the box thus receiving a part of oil with which the sponge is soaked. The device even though probably useful in the art of oiling thread, would likely give rise to difficulties if applied in dyeing thread, mainly due to the fact that only a portion of the thread in is contact with the liquid soaked sponge.

A further improvement in the art is typically represented by U.S. Pat. No. 1,800,253 issued to S. Heilweil on Apr. 14, 1931, which proposes two pieces of absorbent material such as felt which are pressed against each other by a suitable pressure applying means, for instance by a set screw. Between the two felt pieces is passed a thread. Accordingly, any liquid material by which the two absorbent pieces may be soaked, is transformed onto the thread. From the standpoint of the present invention, the Heilweil patent constitutes an advance over Hyde, since the thread is more or less fully enveloped by a soaked absorbent material, thus improving the transfer of dye onto the thread. The drawback of the device, however, is that it is relatively complex and thus expensive and would hardly be useful in the art of portable kits, as it is mainly designed for use in combination with a sewing machine. Generally the same kind of device is shown in Canadian Pat. No. 334,781 issued Aug. 8, 1933 and assigned to Henry Dreyfus. In this device, two absorbent pads are pressed against each other and means are provided for passing a thread therebetween, whereby liquid, by which the two pads are soaked, can be transferred onto the thread. This device, again, is relatively complex and expensive and such is not suitable for a portable manually operated kit for personal use while traveling or the like. A portable, hand-operated device of the above type is shown in U.S. Pat. No. 2,846,705 issued Aug. 12, 1958 to R. W. Marz. The invention utilizes a cylindric box whose upper portion comprises a resilient pad pressing the dressed or coated thread against the top of a cylindric piece of wax or the like housed in the container as the thread passes transversely of same. The flexible pad is finger pressed against the wax or the like piece. The device, while suitable for waxing a thread or the like, would be unacceptable for dyeing by a liquid dye which, on the other hand, is the preferable way of quick and reliable coloring of a thread. Finally, U.S. Pat. No. 2,910,026 issued Oct. 27, 1959 to D. J. Ajouelo and entitled "Instant Thread Dyeing Device" shows a dyeing device generally of the type of a marker whose felt, in use, is inverted downwardly while a thread is passed between the felt tip and a suitable base. The device, while possibly suitable for use with a sewing machine or the like, is difficult to visualize in use as a traveling kit or the like. The device is relatively expensive because a base for supporting the thread and holding the felt piece must be provided.

The aforesaid prior art points out to the fact that those skilled in the art of the said type of dyeing or coating a thread deemed it necessary to always provide two separate pieces of flexible or absorbent material and to pass the processed thread between such pieces, at least one of the pieces usually being provided with means for pressing same against the opposite one. In general, such devices are relatively expensive.

It is an object of the present invention to provide a device generally of the above type but being of extreme simplicity and thus inexpensive to produce, whereby it can be applied to disposable kits for use while travelling or the like.

The gist of the present invention is in eliminating the use of two separate pieces between which the processed thread is to pass and replacing same by a single, dye soaked block of a felt-like material through which a hand sewing needle can easily be passed, thus arriving at what is believed to be the ultimate simplicity of the device.

In general terms, the present invention provides a portable thread dyeing kit comprising, in combination, an enclosed container means including bottom wall means, side wall means and top wall means, said bottom, side and top wall means defining a generally completely enclosed and sealed interior of said container means; said interior of the said container means comprising an integral piece of felt-like absorbent material soaked by a liquid dye, said piece reaching generally up to said top wall means; generally coaxial orifice means disposed in said side wall means at a point relatively remote from said bottom wall means and relatively close to said top wall means, said orifice means being of the size allowing transverse passage through said container of a sewing needle; the arrangement of said orifice means relative to said integral piece being such that a portion of said integral piece is coincident with a transverse centre line of said orifice means.

It is preferred that said interior near said bottom wall means comprise a predetermined volume of liquid dye. This can be accomplished, for instance, by recessing the felt block and filling the thus obtained space with the liquid dye to extend the use of the device.

It is also preferred that the device be provided with cap means adapted to cover the top of the container such as to snugly engage the side walls and to thus close the orifice means.

According to another preferred feature of the present invention, the kit is of the type of a box whose interior is divided by liquid impermeable partition means into a plurality of said container means, each container means comprising a different dye.

It is also preferred that the box be of an elongate, generally rectangular configuration in plan with said partition means extending transversely thereof and, preferably, with said orifice means of each of the container means being a pair of orifices in respective side wall means coaxial relative to a transverse axis generally parallel with said top wall and said partition means and disposed generally centrally between the partition means.

The invention will now be described by way of a preferred embodiment, with reference to the accompanying drawing. In the drawing.

Figure 1:
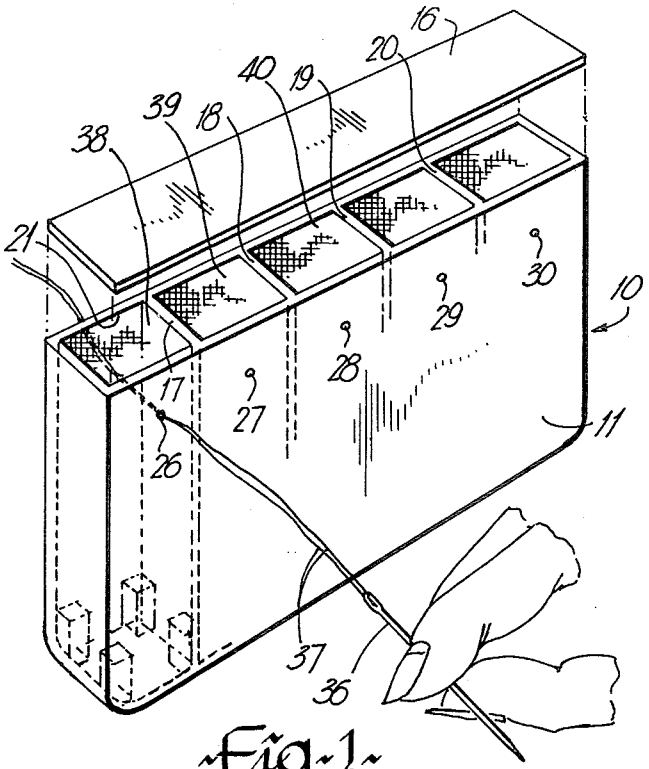
FIG. 1 is a perspective view of a kit according to the present invention, shown without the cap and with the top wall of the container in exploded fashion, prior to the securement to the kit.

Turning now in particular to FIG. 1, it will be seen that the device has the shape of a generally rectangular box. The box as shown is approximately four inches wide, approximately two and a half inches tall and about half an inch thick. The box 10 is made of a suitable plastics material, for instance nylon (trademark) or polyethylene. It has a generally rectangular front wall 11, a corresponding rear wall 12, a left hand side wall 13 and a right hand side wall 14. The lower ends of the respective front, rear and side walls (the walls 11, 12, 13 and 14 also being referred to in general terms as "side wall means") are integral with a bottom wall 15 and with a top wall 16 which is permanently secured, for instance by welding, to the container.

A plurality of partitions 17, 18, 19 and 20 extends transversely between the front and rear walls 11, 12, to provide a plurality of separate compartments 21, 22, 23, 24 and 25.

In the front wall 11 is provided a series of apertures 26, 27, 28, 29 and 30, while the rear wall 12 has a similar series of transversely coaxial apertures 31, 32, 33, 34 and 35. Thus, each of the compartments 21–25 is provided with a pair of apertures 26–31, 27–32, 28–33, 29–34 and 30–35 which are disposed relatively remote from the bottom wall 15 and relatively close to the top wall 16. The orifices are each approximately 1/16" in diameter and are disposed generally centrally of the respective compartments 21–25, the spacing from the top wall 16, when applied, being approximately ⅜". In general terms, the orifice means is selected such as to allow for passage therethrough of a regular size hand sewing needle 36 (FIG. 1). Accordingly, when a thread 37 is threaded in the needle 36, it can easily be passed through the selected one of the said pair of apertures.

Figure 2:
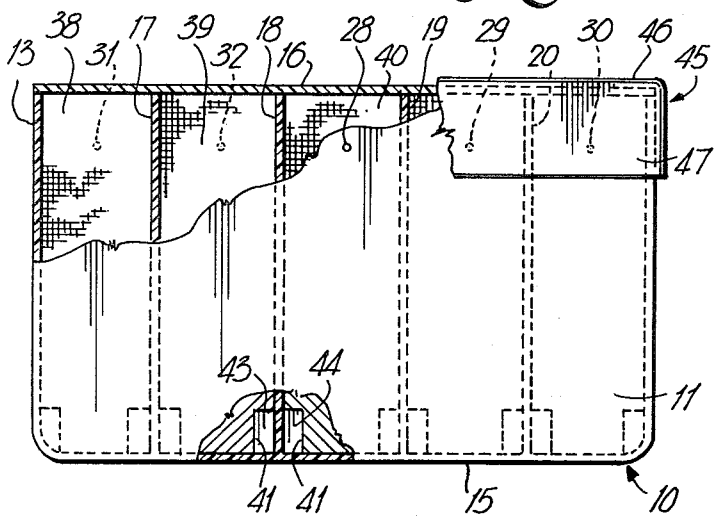
FIG. 2 is a front view, partly in section and partly broken away, of the kit shown in FIG. 1, inclusive the cap.

Within each of the commpartments 21–25 is disposed an integral block of flet, only blocks 38, 39 and 40 of compartments 21, 22 and 23 being shown in FIG. 2 for the sake of clarity. The bottom portion of each block 38, 39, 40, etc. is recessed at 41, while the rest of the respective blocks correspond in planar configuration to the cross section area of the respective compartment. The voids 41 in each of the blocks 39, 40 are filled with a respective liquid dye 43, 44, it being understood that each of the compartments 21–25 is provided with a different dye. The respective felt blocks 38, 39, 40 and the remaining two blocks not shown in the drawings are each soaked with the respective dye before they are inserted into their appropriate compartments. Prior to insertion of the respective soaked block, an appropriate volume of the respective dye 43, 44 and the dyes for the remaining three compartments 21, 24 and 25 are added to extend operational life of the device. Finally, the top wall 16 is fixedly secured, for instance by welding, to the top of the container, whereupon each of the compartments is hermetically enclosed with the exception of passages at the respective apertures 26–35.

Figure 3:
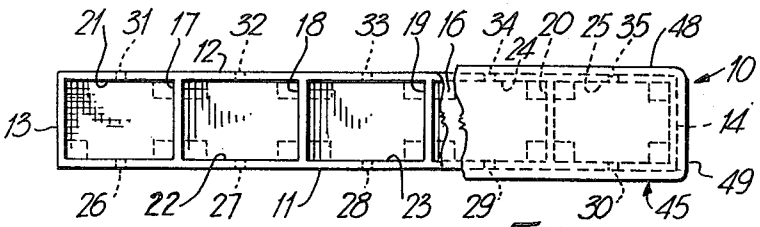
FIG. 3 is a plan view of FIG. 2.

The device preferably includes a cap 45 (not included in FIG. 1) which is of a shape generally complementary with the shape of the container 10. The cap 45 has a top, generally rectangular wall 46, a front wall or skirt portion 47, a rear wall section 48 and two side walls, of which only the right hand side wall 49 is shown in the drawings (FIG. 3). The skirt portion of cap 45 is designed such as to snugly fit over the top of the container, with the front and rear walls 47, 48 reaching below the row of respective apertures 26–35, as seen from FIG. 2.

It was found out that by use of a generally integral felt piece, the effect in dyeing thread 37 as shown in FIG. 1 is not only satisfactory but even better than with separate blocks pressed together thus avoiding the need of the known splitting of the felt or other absorbent material as in prior art.

Those skilled in the art will readily conceive further embodiments departing, to a greater or lesser degree, from the above preferred embodiments. Obviously, the number of compartments 21–25 can vary from a single compartment (i.e. no partition walls) to any number of compartments that may be practical. The shape of the box as shown is preferable but may be changed, particularly if a series of single dye boxes is produced to form a set. The recesses in the blocks 38, 39, 40 and of the remaining two blocks may be different from that shown with respect to both shape and size, the latter depending on the desired volume of the liquid dye reservoir in the respective compartment.

However, the above and many further embodiments departing from the one shown in the drawing do not depart from the scope of the invention as recited in the claims.

The embodiments of the invention in which an exclusive property or privilege is claimed are defined as follows:

1. A portable thread dyeing kit comprising, in combination, a generally completely enclosed and sealed container means including a bottom wall, side walls and a top wall, said container means comprising, interiorly thereof, an integral piece of felt-like absorbent material soaked by a liquid dye, said piece reaching generally up to said top wall;

generally coaxial orifices disposed one in each of said side walls at a point thereof relatively remote from said bottom wall and relatively close to said top wall, said orifices being of the size allowing transverse passage through said container of a sewing needle;

the arrangement of said orifices relative to said integral piece being such that an axis of said orifices extends through a generally solid portion of said integral piece.

2. A kit as claimed in claim 1, wherein a portion of said container means near said bottom wall is filled with the liquid dye.

3. A kit as claimed in claim 1, further comprising a cap complementary with said top wall and including a skirt complementary with a portion of said side walls, said skirt being adapted to cover said orifices when the cap is applied.

4. A kit as claimed 1, 2 or 3, of the type of a box whose interior is divided by liquid impermeable partitions into a plurality of said container means, each container means comprising a different dye.

5. A kit as claimed in claim 1, 2 or 3, of the type of a box whose interior is divided by liquid impermeable partitions into a plurality of said container means, each container means comprising a different dye, the box being of an elongate, generally rectangular configuration in plan, with said partition means extending transversely thereof.

* * * * *